US005457594A

United States Patent [19]

Stoll et al.

[11] Patent Number: 5,457,594

[45] Date of Patent: Oct. 10, 1995

[54] ELECTROPNEUMATIC CONTROL DEVICE

[75] Inventors: Kurt Stoll; Heinz Hohner, both of Deutschland, Germany

[73] Assignee: Festo KG, Esslingen, Germany

[21] Appl. No.: 116,055

[22] Filed: Sep. 2, 1993

[30] Foreign Application Priority Data

Sep. 11, 1992 [DE] Germany ..... 42 30 414.8

[51] Int. Cl.[6] ..... H01H 47/00

[52] U.S. Cl. ..... 361/160; 361/166

[58] Field of Search ..... 361/139, 143, 361/152, 160, 166, 170, 165; 137/614.11

[56] References Cited

U.S. PATENT DOCUMENTS

| | | | |
|---|---|---|---|
| 4,241,375 | 12/1980 | Ruggles | 361/166 |
| 4,385,685 | 5/1983 | Sticht . | |
| 4,638,784 | 1/1987 | Ikeda | 361/165 |
| 4,785,843 | 11/1988 | Nicholson . | |

FOREIGN PATENT DOCUMENTS

| | | |
|---|---|---|
| 3042205C2 | 10/1981 | Germany . |
| 3915456A1 | 11/1990 | Germany . |
| 830163632 | 8/1985 | Japan . |
| 830163634 | 8/1985 | Japan . |
| 900091658 | 5/1991 | Japan . |
| 900259909 | 9/1991 | Japan . |
| 910200930 | 5/1993 | Japan . |
| 2097555 | 11/1982 | United Kingdom . |

OTHER PUBLICATIONS

T. Pfeifer and K. J. Heiler, Aachen, *Zeile Und Anwendungen von Feldbussystemen,* Automatisierungstechnische Praxis, vol. 29, No. 12, 549–557, 1987.

Färber, G., *Bussyteme Parallele Und Serielle Bussysteme In Theorie Und Praxis,* R. Oldenbourg Verlag, 34–35, 1984.

*Primary Examiner*—Jeffrey A. Gaffin

*Attorney, Agent, or Firm*—Hoffmann & Baron

[57] ABSTRACT

An electropneumatic control device having a plurality of valves, each valve being associated with at least one electrically actuatable valve drive. Each valve drive has integrated therein its own bus communication unit and is coupled to a bus line for communication with a central control unit. Actuating control signals are supplied from the central control unit for controlling each of the plurality of valves integrated therein. The valve drives may also include electrical contacts for piercing an insulating sheath of the bus line to make electrical connection with control wires within the bus line. The electropneumatic control device described above reduces design complexity.

12 Claims, 1 Drawing Sheet

ELECTROPNEUMATIC CONTROL DEVICE

BACKGROUND OF THE INVENTION

The invention relates to an electropneumatic control device comprising at least one valve, with which at least electrically actuatable valve drive is associated, which may be supplied with control signals via a bus.

In control devices so far designed by the assignee a sub-plate is present, which contains a fluid distributor and is equipped with a multiplicity of valves. Each valve has its valve drive, which is operated by an electromagnet, and is able to be actuated in a manner responsive to electrical control signals as required. Thus there is a valve station similar to a subassembly or component group, which may be positioned directly adjacent to the machining device to be controlled. The control signals for the valve drives are supplied by a central control unit, which is remote from the valve station, with which it is connected via a field bus. A field bus communication unit is provided at the valve station in order to forward the incoming bus signals to the associated valve drive in accordance with their purpose.

The German patent publication 3,042,205 C2 discloses a control device, in the case of which control signals originating from a central control unit are distributed to the individual valve drives. There is in this case furthermore a provision for individual control modules to be connected between a distribution terminal bar and the respective valve drive.

In all cases there is a considerable design complexity. In the first mentioned case a plurality of lines are required in order to divide up or distribute the bus signals correctly among the valve drives present. In the case of the said German patent publication 3,042,205 C2 a plurality of control modules with a complicated design is necessary without however bus control being possible.

SHORT SUMMARY OF THE INVENTION

One object of the invention is to provide a control device of the type initially mentioned, which substantially reduces the design complexity as regards the transfer of electrical control signals.

In order to achieve this and/or other purposes appearing in the present specification, claims and drawings, in accordance with the present invention the valve drive possesses its own bus communication unit, via which it is able to be connected with the bus line.

It is in this manner that the arrangement of a central field bus communication unit, from which there would then be a complex signal distribution system to each respective valve present, becomes unnecessary. Each valve drive possesses its own bus communication unit, via which it can be directly joined with the bus line. For instance in the case of there being one valve station it is sufficient to pass the bus line through the valve station and to provide there the direct connection of the valve drives equipped with the bus communication units. It would be conceivable to lay one bus line permanently and to equip it with at least one interface via which it might then be connected with a field bus line, which comes from the central control unit. It would furthermore be possible to design the central control unit as an inherent part of a valve station so that only an internal bus line would be necessary, which would lead to the valve drives. In accordance with the invention there are consequently able to be employed in connection with a bus valve and which, can be utilized, dependent on the their design as single valves or as part of a multiple arrangement like a battery, more especially in connection with a valve station. There is generally a more compact structure in which it is less trouble to lay the control signal lines and without the danger of confusion of connections.

Further advantageous forms of the invention are recited in the claims.

In accordance with a further particularly advantageous development of the invention the drive of each given valve is designed in the form of a drive block in which the associated bus communication unit is integrated.

In order to simplify the connection of a respective bus communication unit with the bus line it is possible for the bus communication units to be equipped with clamping means, which can be mounted on the bus line where they create a clamping connection with a reliable contact. The clamping contact means are preferably designed in the form of cutting means so that on mounting them on an insulated bus line they bite through the insulating casing as far as the bus wires.

The bus line is preferably in the form of a dual wire bus line which may be simply laid. The bus communication unit can be designed in the form of a chip, which may be accommodated in the valve drive without any problems and bears an integrated circuit.

Further advantageous developments and convenient forms of the invention will be understood from the following detailed descriptive disclosure in conjunction with the accompanying drawings.

LIST OF THE SEVERAL VIEWS OF THE FIGURES

DETAILED ACCOUNT OF WORKING EMBODIMENTS OF THE INVENTION

Figure 1:
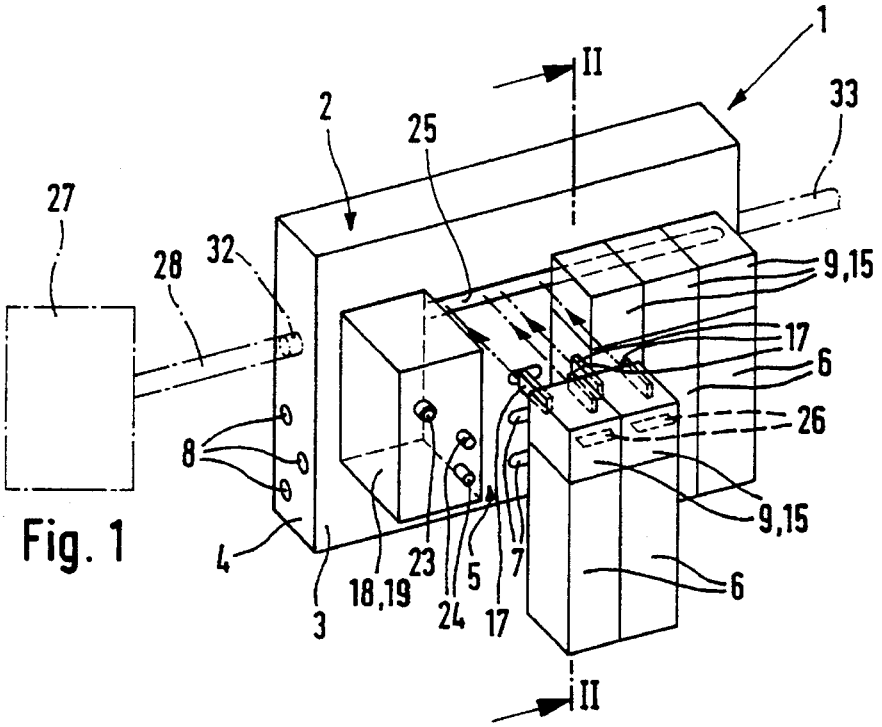
FIG. 1 shows a first possible design of the control device in accordance with the invention with a multiple arrangement of valves as seen in a diagrammatic perspective elevation, two valves equipped with valve drive being depicted in after removal from the subplate of a valve station.

The electropneumatic control device 1 depicted in FIG. 1 comprises a valve stations designed in the form of a subassembly or group of components. In the illustrated working embodiment, this valve station for example possesses a subplate 3, which simultaneously constitutes a fluid distributor or manifold 4 and has a component mounting surface 5 on which a plurality of valves 6 is able to be arranged in a battery-like array. In the case of the valves 6 it is a more especially question of multi-way valves, which communicate by way of valve ducts (not illustrated) and subplate branch ducts 7, only indicated diagrammatically, with header ducts 8 in the interior of the subplate 3. In the illustrated working embodiment one of the latter constitutes a power fluid feed duct, whereas the other ones function as relief or venting ducts. Without any great complexity as regards connections they render possible a supply and/or removal of pneumatic fluid under pressure to and from the valves 6.

In a manner not described in detail the valves 6 are provided with connection means, which make possible the connection of power fluid lines with the loads to be operated. These loads may be constituted by fluid power cylinders for instance. Dependent on the setting of the valves 6 power fluid is supplied to the loads or drained from them in order to operate them in the desired manner. The loads will normally constitute parts of machining stations, for example in industrial production.

Each respective valve 6 is coupled with at least one valve drive 9. In this respect it is convenient for each valve 6 to have its own valve drive 9. For instance the valve drives 9 are directly mounted on the associated valve 6, more especially on one or both the end surfaces thereof. A given valve unit consisting of a valve 6 and of the valve drive 9 is then more particularly detachably secured to the mounting surface 5 or area. It would furthermore be possible to arrange the valve drives 9 additionally or alternatively on the subplate 3.

That section of the subplate 3 which mounts the valves 6 constitutes the fluid distributor 4 in the Working embodiment.

The valve drives 9 are for example solenoids so that it is a question of solenoid valves, which with respect to the respectively associated valve 6 may operate as pilot valves. In the sectional elevation in accordance with FIG. 2 the solenoid 13 is diagrammatically indicated, which receives a magnet armature 14. By means of electrical control signals it is possible to affect the position of the magnet armature 14 and consequently change the position of switching of the respectively associated valve 6.

Each respective valve drive 9 is preferably designed in the form of a drive block 15 and hence constitutes a module-like component. The solenoid 13 and the magnet armature 14 are integrated in the drive block 15. On the connection side 16, which in the occupied condition of the mounting surface 5 is the facing side, electrical contact means 17 project past the outer surface of the drive block 15.

As already mentioned the valve drives 9 are actuated by means of electrical control signals. These control signals are for instance supplied from a central electronic control unit 18, which in the present working embodiment constitutes an inherent component of the valve station 2. In this respect it is a question of a control block 19, which is preferably arranged on the same component mounting surface 5 of the subplate 3 as the valves 6. The same is a compact block-like unit, which may be designed to be removed from the subplate 3.

The central control unit 18 contains the control program for the actuation of the valve drives 9. It may be a question of a fixed program not able to be modified, or, as in the working embodiment of a program able to be adjusted. In FIG. 1 the reader will see an interface 23 on the control block 19, such interface allowing the connection of a personal computer in order to undertake programming tasks therewith.

It will furthermore be seen that there are connection means 24 on the control block for a field bus, not illustrated in detail, via which coupling up of further valve stations 2 becomes possible.

From the central control unit 18 there extends a bus 25, which leads to the valve drives 9. It extends for instance past the valve drives 9 in parallelism thereto. Each valve drive 9 is connected with the bus 25 via the already mentioned electrical contact devices 17 so that each valve drive 9 can be supplied with bus signals, coming from the control unit 18, as control signals.

In order for the bus signals to be interpreted, valve each drive 9 has its own associated bus communication unit 26. The connection with the bus 25 is by way of this bus communication unit, that is to say the bus communication unit 26 processes the bus signals and accordingly ensures that the associated valve drive 9 is correctly actuated at the correct point in time. In the present working embodiment each bus communication unit 26 is integrated in a respective drive block, something is more particularly possible because it is designed in the form of a chip or an integrated circuit. In the illustrated working embodiment in accordance with FIG. 2 a respective bus communication unit 26 is connected between the solenoid 13 and the associated electrical contact devices 17.

In principle it would be possible to design the central control unit 18 as a separate component, which is arranged remote from the valve station 2, as shown in the figure at 27. In this case the connection of a respective valve station 2 is connected via a field bus 28 extending from this control unit 27, said field bus being able to be coupled with the bus line 25 via an interface 32 on the subplate. By means of field bus sections 33 which extend further and are for example also coupled with the bus line 25 it is possible, if desired, for further valve stations 2 or other working stations to be connected, which are able to be operated by bus signals. It would furthermore be quite possible to do without individual interfaces 32 and to utilize a field bus line extending right through, whose section going past the valve station 2 would constitute the bus line 25.

In the case of a valve station 2 equipped with a control block 19 it would also be possible to lay the bus line 25 with an intermediate interface therein or lay it with a continuous conductor to extend to further stations.

Figure 2:
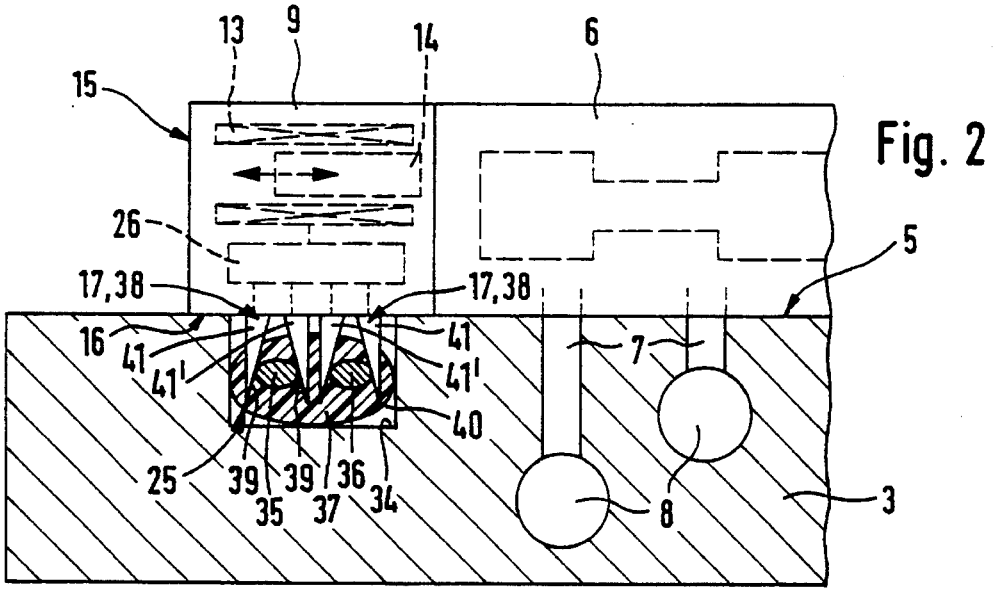
FIG. 2 is a considerably simplified, cross sectional elevation taken through the control device in accordance with FIG. 1 on the section line II—II.

The connection of the individual valve drives 9 with the bus line 25 is possible in the present working embodiment in a particularly simple manner. There is a surface channel 34 provided in the component mounting surface 5, into which the bus line 25 extends along the row of valves 6 underneath the connection sides 16. In this respect the bus line 25 may for example be a twin core bus line, which comprises two control signal wires which, being insulated from one another, are surrounded or encased by an insulating sheath 37 of flexible synthetic resin material. The length of the contact device 17 is so selected that, after mounting the valve drive 9 they extend into the surface channel 34 at least as far as the control signal wire 35 and 36. They are also designed with a cutting means 38 so that on placing the valve drive 9 on the component mounting surface 5 they penetrate into the insulating sheath 37 or pierce the same. The cutting operation proceeds so far that the contact device 17 strikes the control signal wires 35 and 36 and produces an electrical contact with them. This state is depicted in FIG. 2.

There is consequently no longer any need for a complex plug-in contact system, because contact is automatically produced. Special connection means on the bus line 25 are not required.

In the illustrated working embodiment a contact device 17 is provided on each valve drive 9 for each control signal wire to be connected. This contact device 17 comprises in each case two cutting contacts 41 and 41', which are arranged opposite each other with a spacing between them, the longitudinal edges 39 thereof being more particularly designed as knife edges. Their end parts 40 directed away from the drive block 15 taper to a sharp tip. On mounting the same on the bus line the end parts 40 cut through the insulating sheath 34, they then being supported by the longitudinal cutting edges 39. Starting at the terminal or end parts the longitudinal edges 39 extend towards the drive block 15 obliquely towards each other so that the pairs of cutting contacts 41 and 41' straddle the control signal wires 35 and 36 after penetrating them to a certain degree. Owing to the oblique setting and because the insulating sheath 37 bears against the side, which faces away from the drive block 15, preferably on the floor of the surface channel 34, the contact devices 17 are firmly thrust against the control signal wires 35 and 36 so that a connection with a clamping action is obtained.

If the control signal wires 35 and 36 are arranged extremely close together, it may be convenient to arrange the contact devices 17 on the respective valve drive 9 with a relative offset in the longitudinal direction of the bus line 25, as shown in FIG. 1, Without any complex measures the cutting and clamping system in accordance with the working embodiment guarantees a trouble-free electrical connection between the contact devices of the drive blocks 15 and the bus line 25.

It would naturally also be possible to secure the bus line 26 in some other manner. In the present case the subplate 3 practically constitutes a housing, in which the bus line is accommodated in a protected manner. It would also be feasible to arrange the contact devices 17 so as to extend away from the subplate 3 and for connection with the respective bus communication unit 26 to thrust the bus line against the associated contact devices 17.

The design of the contact devices 17 as cutting means may be unnecessary if a bus line 25 is utilized having no sheath on the control signal wires or only having one covering part thereof. The wires might then be arranged permanently on a printed circuit board.

In the case of the twin core bus line 25 in accordance with the embodiment of the invention the control unit 18 and 17 supplies the necessary control signals, more particularly in a serial transmission mode. Each bus communication unit 26 can receive the control signals and recognizes them as being intended for its valve 6. As soon as the control signal has correctly arrived and/or the respective valve 6 has been correctly operated, it is possible for the bus communication unit 26 to generate an acknowledgement signal. It is convenient if in the case of both bus communication units the control signals (confirmation and acknowledgement signals) are simultaneously conducted along the two control signal wires 35 and 36.

Preferably the power supply for the valve drives 9 and/or the bus communication units 26 is via the bus line 25. This means that not only the control signals but furthermore the power for operation is transmitted by means of the bus to the means needing it.

In the illustrated working embodiment one respective valve drive 9 and one bus communication unit 26 constitute one structural unit, which is more especially block-like. This ensures extremely simple assembly without the danger of confusion of connections.

Figure 3:
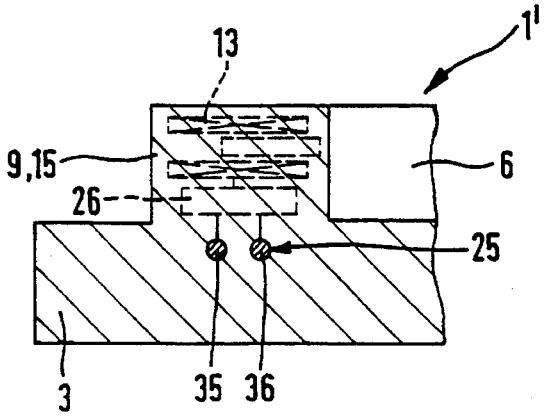
FIG. 3 shows a further design of a control device in a manner of representation similar to that of FIG. 2.

With the embodiment of the control device 1' depicted in FIG. 3 a further simplification is obtained. In this case the valve drives 9 together with their bus communication units 26 are designed in the form of an integral component of the subplate 3. In comparison with the design of FIG. 2 it is to be noted the drive block 15 is now connected integrally with the subplate 3. In this case the bus communication unit 26 is electrically connected with the control signal wires without any mechanical coupling, which wires may be an integral part of the subplate 3 if desired. The only assembly operation required in the case of this embodiment of the invention is then mounting of the valves 6 on the subplate 3, something which is simultaneously performed with the connection with the valve drives 9.

A substantial advantage of the invention is to be seen in the fact that the designer is not forced to adopt a battery-like valve arrangement. In case of need it would be feasible to utilize valves with an associated intelligent valve drive 9, that is to say one having a bus communication unit 9, as a single valve. Then it is possible to mount one or more of such valves at the site which is respectively most suitable and it or they would then be connected via the line and as a rule flexible bus line with the centrally arranged control unit 18. The result would then be an extremely universal or general purpose possibility of use and assembly.

It will be clear that the bus 25 may be an optical one instead of an one for electrical signals.

We claim:

1. An electropneumatic control device, comprising a plurality of valves, each of said valves being associated with at least one electrically actuatable valve drive, said valve drives being supplied with control signals via a bus line which is connected to a central control unit, wherein each of said valve drives includes a bus communication unit which is integrated into the respective valve drive and which is connected with the bus line for communication with said control unit, each of said valve drives being provided with electrical contact means which are electrically connected with the respective internal bus communication unit, said bus line comprising a plurality of signal wires which are surrounded by an insulating sheath, said valve drives including said electrical contact means being electrically coupled to the bus line, wherein said electrical contact means include cutting means for piercing the insulating sheath of the bus line thereby making electrical contact with the signal wires of the bus line.

2. The control device as claimed in claim 1 wherein the valve drive of each respective valve comprises a drive block.

3. The control device as claimed in claim 1, further comprising at least one valve station comprising a fluid distributor equipped with a plurality of said valves, the valve drives of said valves being connected to said bus line.

4. The control device as claimed in claim 3, wherein the control unit comprises a control block which is attached to the fluid distributor.

5. The control device as claimed in claim 4, wherein the valve station comprises a housing, said bus line running through said housing, said housing including the fluid distributor.

6. The control device as claimed in claim 1, wherein said bus line comprises a twin wire bus.

7. The control device as claimed in claim 6, wherein the wires of the bus line provide for transmission of control signals from the control unit to the bus communication units and for return of acknowledgement signals from the bus communication units to the control unit.

8. The control device as claimed in claim 1, wherein the power supply for the bus communication units is provided via the bus line.

9. The control device as claimed in claim 1, wherein the power supply for the valve drives is provided via the bus line.

10. An electropneumatic control device, comprising a plurality of valves, each of said valves being associated with at least one electrically actuatable valve drive, said valve drives being supplied with control signals via a bus line, the bus line being connected to a central control unit, wherein each valve drive includes a bus communication unit therein, the bus communication unit being connected to the bus line for communication with said control unit, at least one of said valve drives and its associated bus communication unit being in the form of an integral component of a subplate, the associated valve being connectable thereto.

11. The control device as claimed in claim 10, wherein the bus communication unit is wired to the bus line within said subplate.

12. The control unit as claimed in claim 10 wherein said subplate includes a fluid distributor.

* * * * *